US006107919A

United States Patent [19]

Wilks et al.

[11] Patent Number: 6,107,919

[45] Date of Patent: Aug. 22, 2000

[54] DUAL SENSITIVITY MODE SYSTEM FOR MONITORING PROCESSES AND SENSORS

[75] Inventors: Alan D. Wilks, Mount Prospect; Stephan W. Wegerich, Glendale Heights; Kenneth C. Gross, Bolingbrook, all of Ill.

[73] Assignee: ARCH Development Corporation, Chicago, Ill.

[21] Appl. No.: 09/256,884

[22] Filed: Feb. 24, 1999

[51] Int. Cl.[7] ..... G08B 29/00

[52] U.S. Cl. ..... 340/511; 340/506; 340/511; 340/514; 340/825.06; 324/527; 324/528

[58] Field of Search ..... 340/514, 506, 340/511, 825.06; 324/527, 528

[56] References Cited

U.S. PATENT DOCUMENTS 5,504,473 4/1996 Cecic et al. ..... 340/541
5,552,763 9/1996 Kirby ..... 340/506
5,578,988 11/1996 Hoseit et al. ..... 340/522
5,786,755 7/1998 Cicchino et al. ..... 340/506
5,870,022 2/1999 Kuhnly et al. ..... 340/567

*Primary Examiner*—Daryl Pope
*Attorney, Agent, or Firm*—Michael D. Rechtin; Foley & Lardner

[57] ABSTRACT

A method and system for analyzing a source of data. The system and method involves initially training a system using a selected data signal, calculating at least two levels of sensitivity using a pattern recognition methodology, activating a first mode of alarm sensitivity to monitor the data source, activating a second mode of alarm sensitivity to monitor the data source and generating a first alarm signal upon the first mode of sensitivity detecting an alarm condition and a second alarm signal upon the second mode of sensitivity detecting an associated alarm condition. The first alarm condition and second alarm condition can be acted upon by an operator and/or analyzed by a specialist or computer program.

20 Claims, 12 Drawing Sheets

DUAL SENSITIVITY MODE SYSTEM FOR MONITORING PROCESSES AND SENSORS

The United States Government has rights in this invention pursuant to Contract W-31-109-ENG-38 between the U.S. Department of Energy and the University of Chicago.

The present invention is generally concerned with a system and method for reliably monitoring a process or a data source, such as sensor or stream of data, for evaluating the state of a process or reliability of the data. More particularly, the invention is directed to a system and method for monitoring a process or data source by simultaneously using more than one level of sensitivity in performing the monitoring. Such different levels of sensitivity allow simultaneous performance of different functionalities.

Conventional parameter-surveillance schemes are sensitive only to gross changes in the mean value of a process, or to large steps or spikes that exceed some threshold limit check. Further, these methods have only a single level of dedicated sensitivity for alarm conditions. These conventional methods also suffer from either large numbers of false alarms (if thresholds are set too close to normal operating levels) or a large number of missed (or delayed) alarms (if the thresholds are set too expansively). Moreover, most conventional methods cannot perceive the onset of a process disturbance or sensor deviation which gives rise to a signal below the threshold level for an alarm condition and cannot simultaneously monitor for alarm conditions at two or more levels of sensitivity.

Further, a number of prior art systems are virtually fully automated such that notices to a user, or alarm conditions, do not provide adequate information about the level of deviation from a desired operation state or a target pattern. A number of individual processes can, for example, drift from an ideal operating state but still be acceptable for the intended industrial application. Inappropriate alarms can therefore result in unnecessary shut down of an industrial process or require unnecessary servicing and repair of the industrial equipment involved.

It is therefore an object of the invention to provide an improved method and system for monitoring a process or data source to assess the state of that process or data source.

It is another object of the invention to provide a novel method and system for simultaneously operating on data with more than one level of sensitivity to provide alarm information for different functionalities.

It is a further object of the invention to provide an improved method and system for applying a pattern recognition technique at varying levels of sensitivity to simultaneously provide different alarm information depending on the intended uses of the alarm information. It is an additional object of the invention to provide a novel method and system for assessing the reliability of a data source at different user programmable levels of sensitivity and also programmably variable over time.

It is yet another object of the invention to provide an improved method and system for applying a Sequential Probability Ratio Test (hereafter "SPRT") with adjustable levels of sensitivity to monitor a process and meet a required plurality of monitoring functionalities.

SUMMARY OF THE INVENTION

An approach to the use of pattern recognition methodologies has been devised that not only overcomes the limitations of prior art pattern recognition systems, but brings substantial auxiliary benefits in the form of improved diagnostic and prognostic information for system engineers having various types of needs. After a training phase, for a preferred embodiment of a dual-mode (or multiple-mode) pattern recognition system (most preferably a sequential probability ratio test ("SPRT")) system, a total of eight separate decision tests are conducted simultaneously in real time for each new incoming signal observation. The first four SPRT decision tests are these:

(1) a positive mean test with a signal disturbance magnitude of $M_1^+$ (2) a negative mean test with a signal disturbance magnitude of $M_1^-$ (3) a nominal variance test with variance-gain factor $V_1$ (4) an inverse variance test with variance-gain factor $1/V_1$ Tests (1) and (2) determine if a signal is starting to drift in a positive direction or a negative direction, respectively. Test (3) detects a change-of-gain failure when the signal mean does not change, but the noise associated with the signal increases. Test (4) detects a change-of-gain failure with a decreasing noise level.

The second set of four SPRT decision test are:

(5) a positive mean test with a signal disturbance magnitude of $M_2^+$ (6) a negative mean test with a signal disturbance magnitude of $M_2^+$ (7) a nominal variance test with variance-gain factor $V_2$ (8) an inverse variance test with variance-gain factor $1/V_2$ Tests (1)–(4) are set up for the equipment operator or routine end user. As such, the values of $M_1^+$, $M_1^-$, and $V_1$ are set to relatively large values so that any alarms generated are indicative of disturbances that are sufficiently severe to warrant prompt operator intervention. Tests (5)–(8) are set up with the usual, ultra-sensitive values for $M_2^+$, $M_2^-$, and $V_2$. These high-sensitivity tests generate warnings that can be logged to a maintenance database for the benefit of system engineers, or other personnel having different needs, such as a line operator or other person in another field of use. In this way, system engineers can ascertain the incipience or onset of very subtle disturbances and may determine, by changes in SPRT tripping frequencies, the temporal evolution of the degradation. Thus, for any instrumentation, components, or sensors that may display only very slight degradation that is still well within the acceptable operational performance range, the system engineers can plan for maintenance actions, such as, for example, instrumentation recalibration, rotating shaft realignment and bearing replacement. These functions can then take place at a convenient time when any impact on system operations or plant availability will be minimal.

Other objects, features and advantages of the present invention will be readily apparent from the following description of the preferred embodiments thereof, taken in conjunction with the accompanying drawings described below.

DETAILED DESCRIPTION OF PREFERRED EMBODIMENTS

Figure 1A:
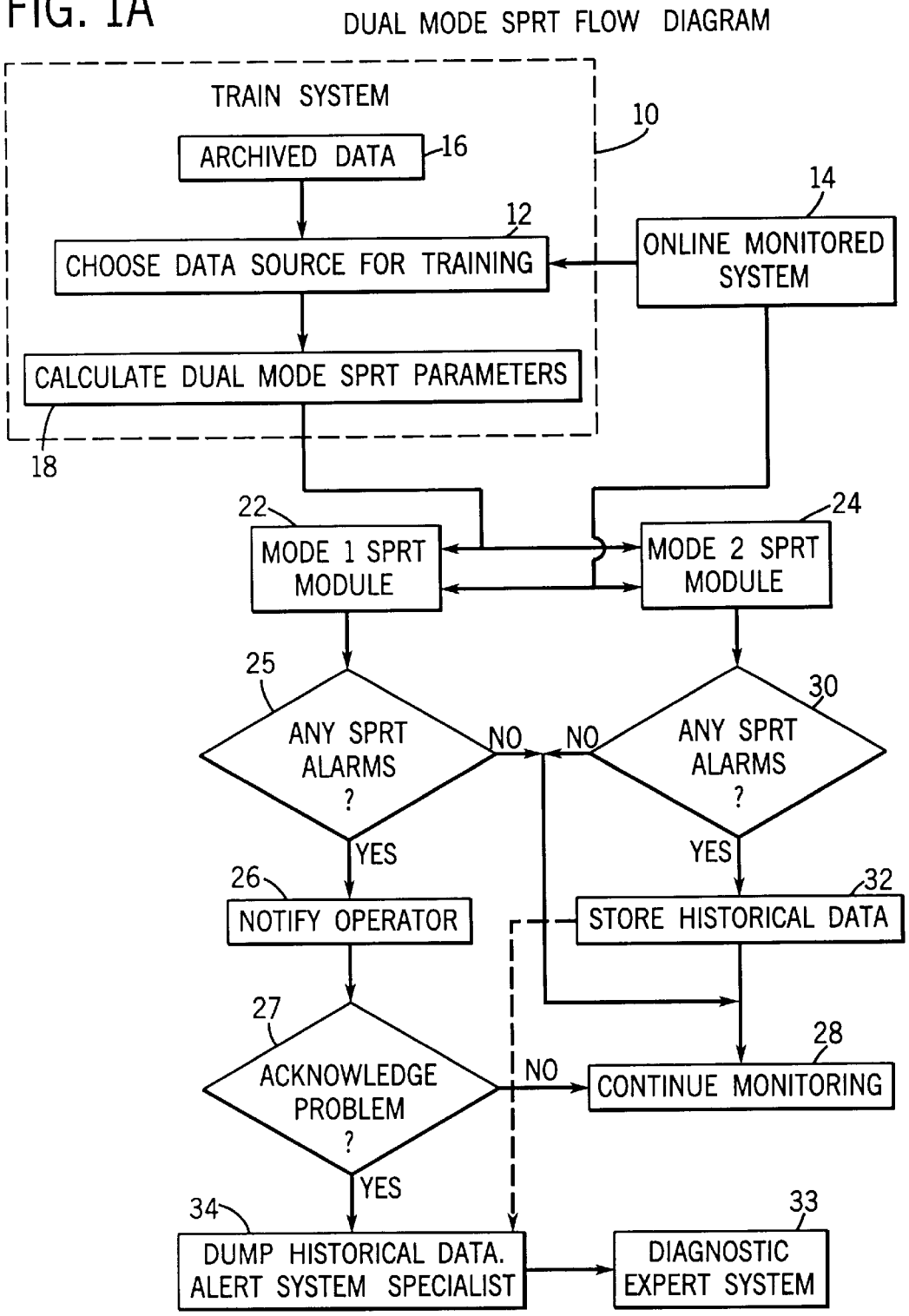
FIG. 1A illustrates a flow diagram of a dual mode sensitivity pattern recognition process as applied to incoming data and FIG. 1B illustrates a flow diagram of a dual mode pattern recognition expert system which is the diagnostic portion of the system illustrated in FIG. 1A.
Figure 1B:
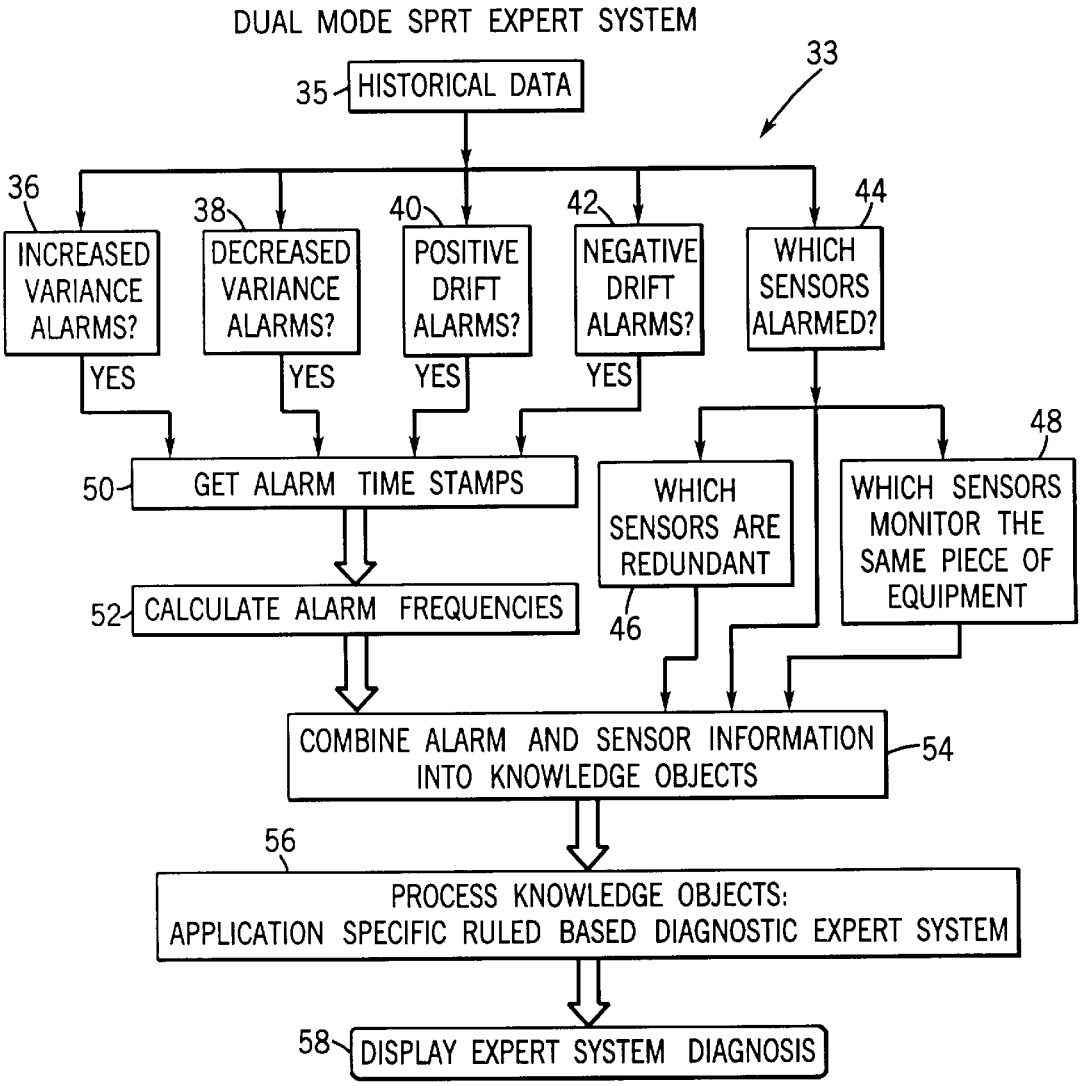

In a method of the invention, a pattern recognition technique is applied to analyze a process, device or data source in the manner shown generally in FIGS. 1A and 1B. Initially a training process ensues as shown within dotted box 10 in FIG. 1A. In this training process, a preferred first step 12 is to choose between two sources of data: from an online monitored system 14 or from archived data 16. In a subsequent step 18 of the training process, pattern recognition parameters are determined for a plurality of levels of sensitivity.

In a preferred embodiment, the pattern recognition technique used for analysis can be a sequential probably ratio test ("SPRT") procedure. This specific methodology is very effective for the intended purposes. Details of this SPRT process are disclosed, for example, in U.S. Pat. Nos. 5,223,207; 5,459,675 and 5,629,872, which are incorporated by reference herein in their entirety as related to the SPRT method. The procedures followed in this preferred SPRT method are shown generally in FIGS. 2A and B and also are described in detail hereinafter. In performing such a preferred analysis of the sensor signals, an example is described in FIGS. 1A and B in the form of a dual transformation method. The method entails both a frequency-domain transformation of the original time-series data and a subsequent time-domain transformation of the resultant data. The data stream that passes through the dual frequency-domain, time-domain transformation is then processed with a pattern recognition system, such as the SPRT procedure which uses a log-likelihood ratio test.

In the preferred pattern recognition method of SPRT, successive data observations are performed on a discrete process Y, which represents a comparison of the stochastic components of physical processes monitored by a sensor, and most preferably by pairs of sensors. In practice, the Y function is obtained by simply differencing the digitized signals from two respective sensors. Let $Y_k$ represent a sample from the process Y at time $t_k$. During normal operation with an undegraded physical system and with sensors that are functioning within specifications, the $Y_k$ should be normally distributed with mean of zero. Note that if the two signals being compared do not have the same nominal mean values (due, for example, to differences in calibration), then the input signals will be pre-normalized to the same nominal mean values during initial operation.

In performing the monitoring of industrial processes, the system's purpose is to declare a first system and/or a second system as being degraded if the drift in Y is sufficiently large that the sequence of observations appears to be distributed about a mean +M or −M, where M is a pre-assigned system-disturbance magnitude. A quantitative framework can be devised that enables us to decide between two hypotheses, namely:

$H_1$: Y is drawn from a Gaussian probability distribution function ("PDF") with mean M and variance $\sigma^2$.

$H_2$: Y is drawn from a Gaussian PDF with mean 0 variance $\sigma^2$.

We will suppose that if $H_1$ or $H_2$ is true, we wish to decide for $H_1$ or $H_2$ with probability (1-β) or (1-α), respectively, where α and β represent the error (misidentification) probabilities.

From the conventional, well-known theory of Wald, the test depends on the likelihood ratio $1_n$, where $$1_n = \frac{\text{The probability of observed sequence } y_1, y_2 \ldots, y_n \text{ given } H_1 \text{ true}}{\text{The probability of observed sequence } y_1, y_2 \ldots, y_n \text{ given } H_2 \text{ true}} \tag{1}$$

After "n" observations have been made, the sequential probability ratio is just the product of the probability ratios for each step:

$$1_n = (PR_1)\cdot(PR_2)\cdot \cdots \cdot(PR_n) \tag{2}$$

or $$1_n = \prod_{1=l}^{1=n} \frac{f(y_i \mid H_1)}{f(y_i \mid H_2)} \tag{3}$$

where $f(y_i|H)$ is the distribution of the random variable y.

Wald's theory operates as follows: Continue sampling as long as $A<1_n<B$. Stop sampling and decide $H_1$ as soon as $1_n \geqq B$, and stop sampling and decide $H_2$ as soon as $1_n \leqq A$. The acceptance thresholds are related to the error (misidentification) probabilities for the following expressions:

$$A = \frac{\beta}{1-\alpha}, \text{ and } B = \frac{1-\beta}{\alpha} \tag{4}$$

The (user specified) value of $\alpha$ is the probability of accepting $H_1$ when $H_2$ is true (false alarm probability). $\beta$ is the probability of accepting $H_2$ when $H_1$ is true (missed alarm probability).

If we can assume that the random variable $Y_k$ is normally distributed, then the likelihood that $H_1$ is true (i.e., mean M, variance $\sigma^2$) is given by:

$$L(y_1, y_2 \ldots, y_n \mid H_1) = \frac{1}{(2\pi)^{n/2}\sigma^n}\exp\left[1\frac{1}{2\sigma^2}\left(\sum_{k=1}^{n} yk^2 - 2\sum_{k=1}^{n} y_k M + \sum_{k=1}^{n} M^2\right)\right] \tag{5}$$

Similarly for $H_2$ (mean 0, variance $\sigma^2$):

$$L(y_1, y_2 \ldots, y_n \mid H_2) = \frac{1}{(2\pi)^{n/2}\sigma^n}\exp\left(\frac{1}{\sigma^2\sum_{k=1}^{n} y_k^2}\right) \tag{6}$$

The ratio of (5) and (6) gives the likelihood ratio $1_n$ $$1_n = \exp\left[-\frac{-1}{2\sigma^2}\sum_{k=1}^{n} M(M-2y_k)\right] \tag{7}$$

Combining (4) and (7), and taking natural logs gives $$1_n\frac{\beta}{1-\alpha} < \frac{-1}{2\sigma^2}\sum_{k=1}^{n} M(M-2y_k) < 1_n\frac{(1-\beta)}{\alpha} \tag{8}$$

Our sequential sampling and decision strategy can be concisely represented as:

$$\text{If } 1_n \le 1n\frac{\beta}{1-\alpha}, \text{ Accept } H_2 \tag{9}$$

$$\text{If } 1n\frac{\beta}{1-\alpha} < 1_n < 1n\frac{1-\beta}{\alpha}, \text{ Continue Sampling} \tag{10}$$

$$\text{And if } 1_n \ge 1n\frac{1-\beta}{\alpha}, \text{ Accept } H_1 \tag{11}$$

Following Wald's sequential analysis, it is conventional that a decision test based on the log likelihood ratio has an optimal property; that is, for given probabilities $\alpha$ and $\beta$ there is no other procedure with at least as low error probabilities or expected risk and with shorter length average sampling time.

A primary limitation that has heretofore precluded the applicability of Wald-type binary hypothesis tests for sensor and equipment surveillance strategies lies in the primary assumption upon which Wald's theory is predicated; i.e., that the original process Y is strictly "white" noise, independently-distributed random data. Such white noise can, for example, include Gaussian noise. It is, however, very rare to find physical process variables associated with the operating machine that are not contained with serially-correlated noise components includes, for example, auto-correlated and a Markov dependent noise. This invention can overcome this limitation to conventional surveillance strategies by integrating the Wald sequential-test approach with a new dual transformation technique. This symbiotic combination of frequency-domain transformations and time-domain transformations produces a tractable solution to a particularly difficult problem that has plagued signal-processing specialists for many years.

Figure 2A:
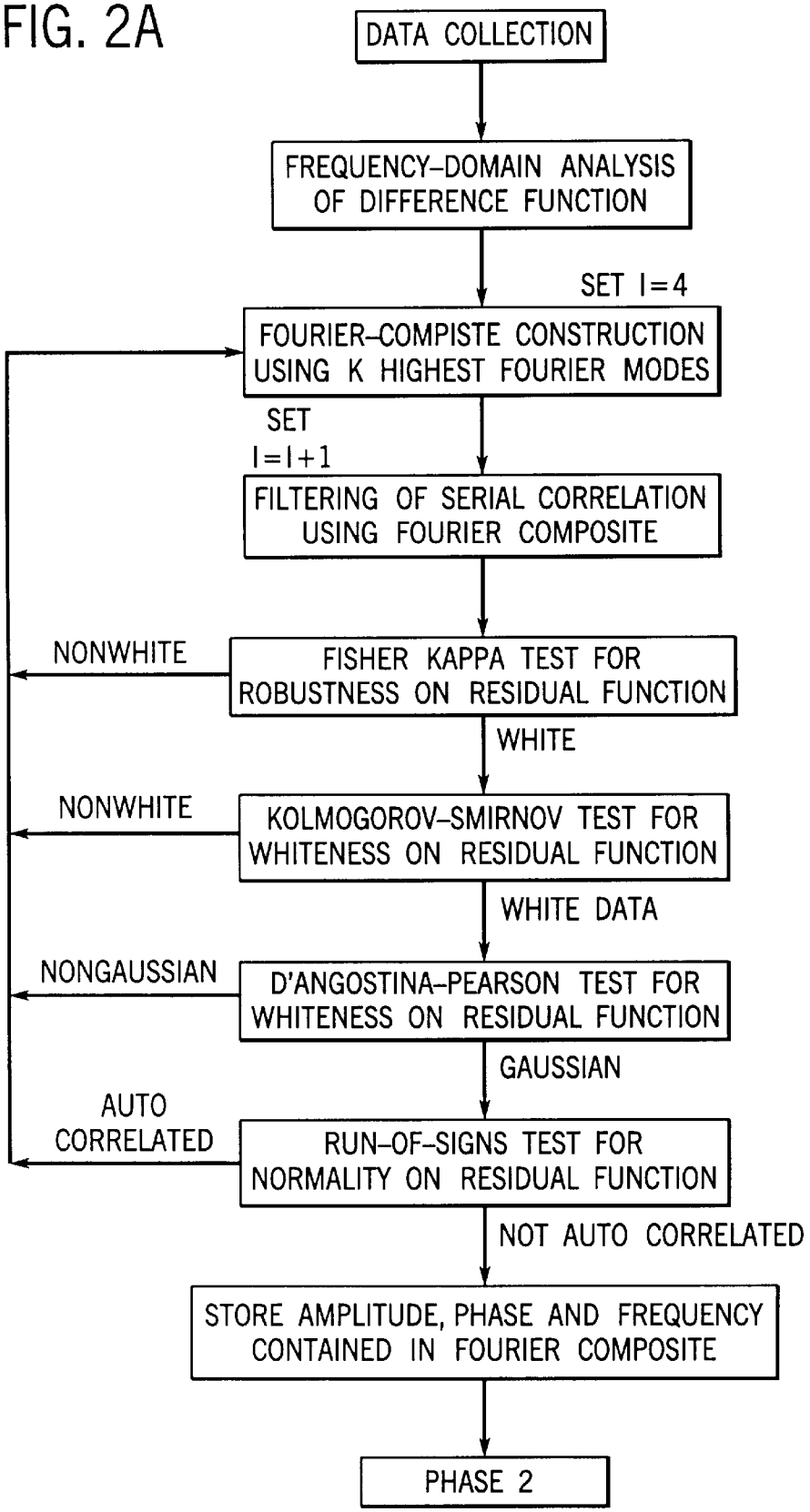
FIGS. 2A and 2B illustrate schematic functional flow diagrams of SPRT processing form of pattern recognition with FIG. 2A showing a first phase of the SPRT method and FIG. 2B showing an application of the technique.
Figure 2B:
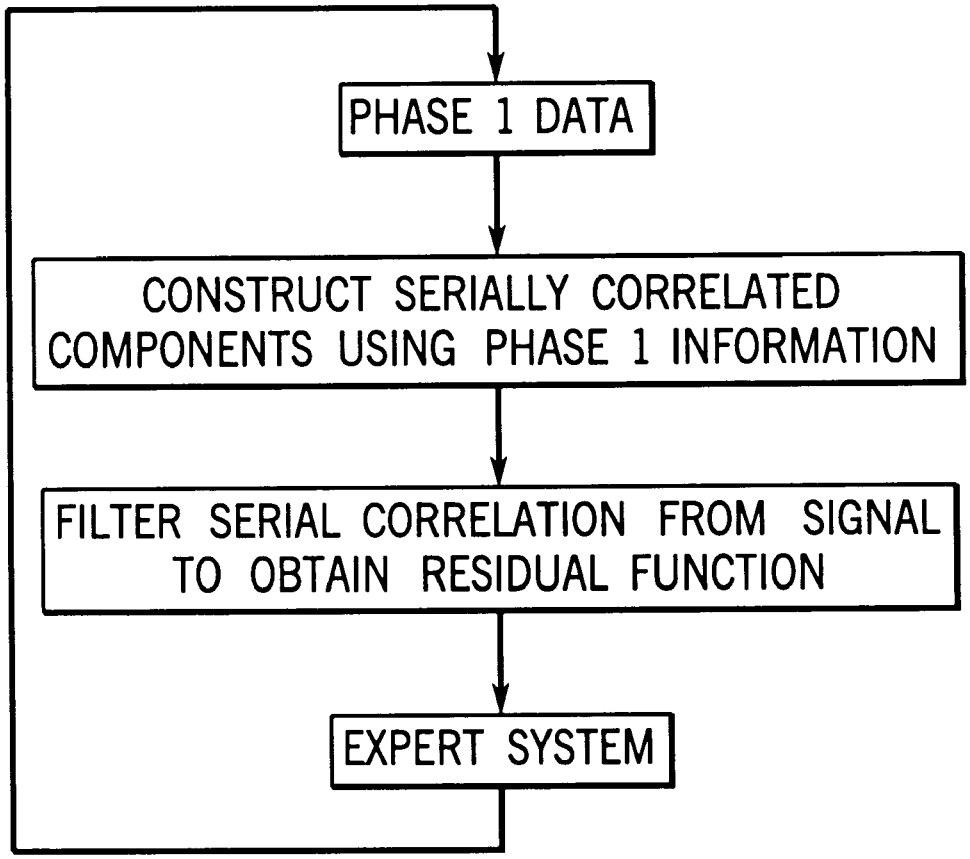

In the preferred pattern recognition method of SPRT shown in detail in FIGS. 2A and 2B, serially-correlated data signals from an industrial process (or other data source) can be rendered amenable to the SPRT testing methodology described hereinbefore. This is preferably done by performing a frequency-domain transformation of the original differenced function Y. A particularly preferred method of such a frequency transformation is accomplished by generating a Fourier series using a set of highest "1" number of modes. Other procedures for rendering the data amenable to SPRT methods includes, for example, auto regressive techniques which can accomplish substantially similar results described herein for Fourier analysis. In the preferred approach of Fourier analysis to determine the "1" highest modes (see FIG. 2A):

$$Y_t = \frac{\alpha_0}{2} + \sum_{m=1}^{\frac{N}{2}} (a_m\cos\omega_m t + b_m\sin\omega_m t) \tag{12}$$

Where $a_o/2$ is the mean value of the series, $a_m$ and $b_m$ are the Fourier coefficients corresponding to the Fourier frequency $\omega_m$, and N is the total number of observations. Using the Fourier coefficients, we next generate a composite function, $X_t$, using the values of the largest harmonics identified in the Fourier transformation of $Y_t$. The following numerical approximation to the Fourier transform is useful in determining the Fourier coefficients $a_m$ and $b_m$. Let $x_j$ be the value of $X_t$ at the jth time increment. Then assuming $2\pi$ periodicity and letting $\omega_m$=2 $\pi$m/N, the approximation to the Fourier transform yields:

$$a_m = \frac{2}{N}\sum_{j=0}^{N-1} X_j\cos\omega_m j \tag{13}$$

$$b_m = \frac{2}{N}\sum_{j=0}^{N-1} X_j\sin\omega_m j$$

For the 0<m<N/2. Furthermore, the power spectral density ("PSD") function for the signal is given by $1_m$ where $$1_m = N\frac{a_m^2 + b_m^2}{2} \tag{14}$$

To keep the signal bandwidth as narrow as possible without distorting the PSD, no spectral windows or smoothing are used in our implementation of the frequency-domain transformation. In analysis of a pumping system of the EBR-II reactor of Argonne National Laboratory, the Fourier modes corresponding to the eight highest $1_m$, provide the amplitudes and frequencies contained in $X_t$. In our investigations for the particular pumping system data taken, the highest eight $1_m$ modes were found to give an accurate reconstruction of $X_t$ while reducing most of the serial correlation for the physical variables we have studied. In other industrial processes or from other data sources, the analysis could result in more or fewer frequency modes being needed to accurately construct the functional behavior of a composite curve. Therefore, the number of modes used is a variable which is iterated to minimize the degree of nonwhite noise for any given application. As noted in FIG. 2A a variety of noise tests are applied in order to remove serially correlated noise.

The reconstruction of $X_t$ uses the general form of Eqn. (12), where the coefficients and frequencies employed are those associated with the highest PSD values. This yields a Fourier composite curve (see end of flowchart in FIG. 2A) with essentially the same correlation structure and the same mean as $Y_t$. Finally, we generate a discrete residual function $R_t$ by differencing corresponding values of $Y_t$ and $X_t$. This residual function, which is substantially devoid of serially correlated contamination, is then processed with the SPRT technique described hereinbefore.

Returning now to the general method of the invention shown in FIGS. 1A and 1B, as described hereinbefore, the next step in the training process 10 is to calculate the pattern recognition parameters, such as the dual mode SPRT parameters. At least two levels of sensitivity can be determined for evaluating the incoming data. In the case of a SPRT approach, included in this step 18 is a calculation of the stopping thresholds determined from a user specified false and missed alarm probabilities, the sample disturbance magnitude calculated from the user specified sensitivity levels for each of the levels of sensitivity, the variance of each of the monitored data and the mean of each of the monitored data.

After the training step 10 is completed, the methodology continues by monitoring the data (either the archived data or the online monitored data) which is fed into two (or more) separate SPRT modules 22 and 24. As stated hereinbefore, other types of pattern recognition methods can also be used to perform the general function of monitoring at two or more levels of sensitivity. The SPRT module 22 is designated as a lower sensitivity implementation which is often best used for a human operator with modest level of knowledge and not necessarily having a need to understand small deviations from a typical operating state. The SPRT module 24 can be operated at another higher sensitivity level to provide information of a different variety, such as, for example, for purposes of sophisticated monitoring for long term maintenance or for evaluating the system for early signs of potential catastrophic failure. Numerous other needs can therefore be met by simultaneously monitoring the data source using a plurality of different sensitivities to provide different information appropriate to the need.

During operation of the multi-mode sensitivity methodology when the SPRT module 22 detects an alarm condition in step 25 pursuant to the condition of sensitivity established, an alert is generated to the operator in step 26. The operator can then acknowledge the alarm in step 27 and act accordingly. Historical data can be sorted, and a specialist with substantial expertise can also be alerted. In addition, the system can continue to monitor the process in step 28.

If the higher sensitivity SPRT module 24 detects an alarm condition in step 30 under the higher sensitivity conditions established, the relevant data can be processed and stored as historical data in step 32. An appropriate specialist can be notified in step 34 or a sophisticated computer diagnostic analysis can also be performed as described hereinafter. Monitoring of the data source can also continue, in step 27 enabling detection and analyzation of further conditions or states of the data source being evaluated.

When the methodology in FIG. 1A detects an alarm condition, a diagnostic mode can then be activated as diagnostic expert system 33 shown as a single box in FIG. 1A and shown in detail in FIG. 1B. In the diagnostic expert system 33 the historical data 35 is parsed into more compact bits of information by determining which one of a set of various statistical tests 36, 38, 40 or 42, for example, produced the alarm. At the same time descriptive information, characteristic of the data source or universe being sampled, is constructed specifically for the particular system being monitored.

Furthermore, in step 44 when the data source (such as a sensor) has generated an alarm signal, the identity of the sensor which has alarmed is established. Further, the redundancy of the sensor is established in step 46, and also identified in step 48 are the sensors monitoring the same component or piece of equipment.

After the different statistical tests are identified in steps 36, 38, 40 and 42, time stamps are assigned in step 50 for the occurrence of each alarm and stored to memory, and the step of calculating alarm frequency for each sensor is completed in step 52. In another preferred step 54, knowledge objects are created, and these objects contain the condensed SPRT alarm information along with descriptive sensor information (such as which sensors alarmed, redundant sensors and which sensors monitor that same equipment). These knowledge objects can then be processed by the application specific, rule-based diagnostic system 56. This diagnostic system 33 typically comprises a computer software module which applies logic and rules specific to the particular system or process being monitored by the multi-level sensitivity SPRT (or pattern recognition) system. These rules and logic structures are used to determine whether or not a sensor or sensors are beginning to fail or the system is beginning to fail or deviate in some other way. The diagnostic system 33 then deduces the source of the failure and the results output in step 58.

The following non-limiting examples illustrate one form of the invention and its application.

EXAMPLE I

Figure 3A:
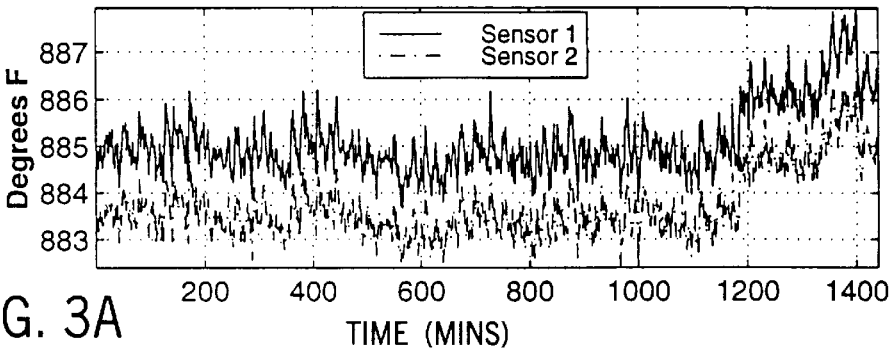
FIG. 3A illustrates subassembly outlet temperatures 4E1 and 4F1 using sensors 1 and 2, respectively, for normal operating conditions of the EBR-II nuclear reactor.
Figure 3B:
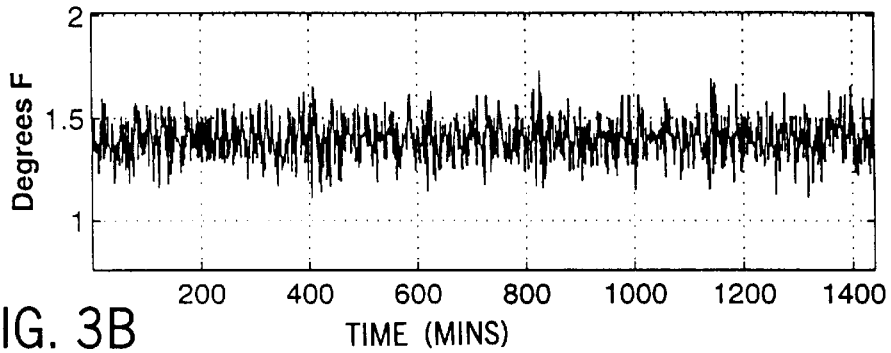
FIG. 3B shows a residual function for SPRT analysis of the data of FIG. 3A.
Figure 3C:
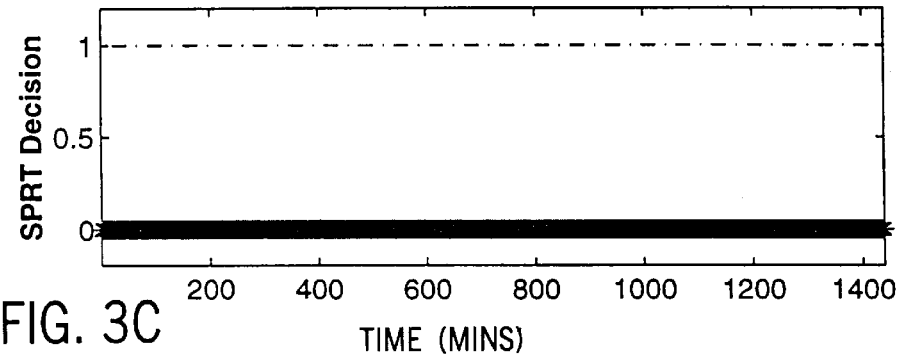
FIG. 3C shows mean values of mode 1 SPRT indicators (either 0 or 1 indicative of not achieving or achieving the threshold for an alarm) for analysis of the data of FIG. 3A
Figure 3D:
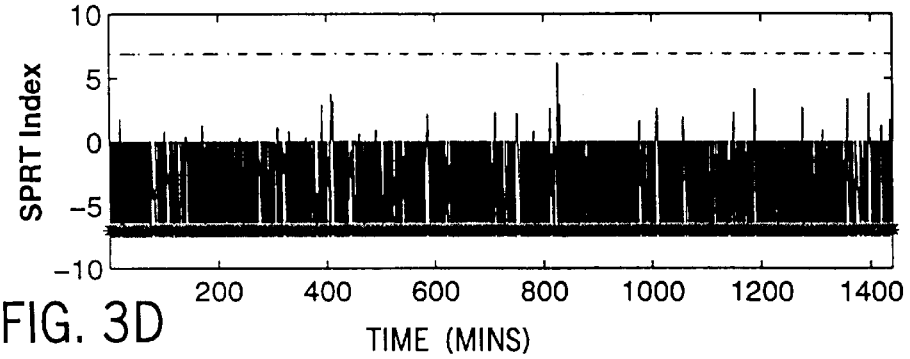
FIG. 3D shows mean values of mode 2 SPRT indices (actual SPRT output values) for analysis of the data of FIG. 3A.
Figure 4A:
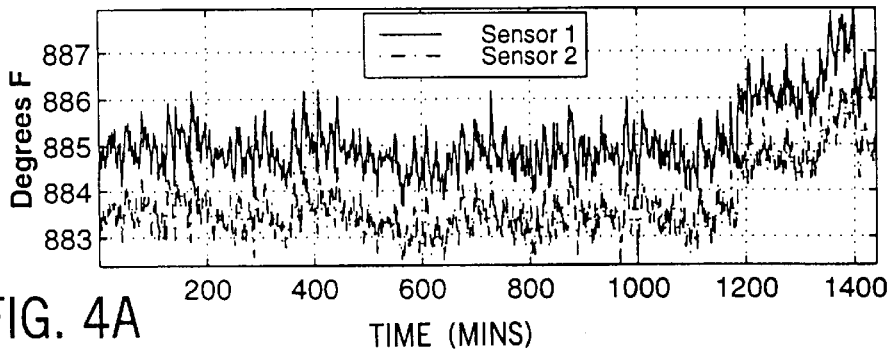
FIG. 4A illustrates the same data of FIG. 3A.
Figure 4B:
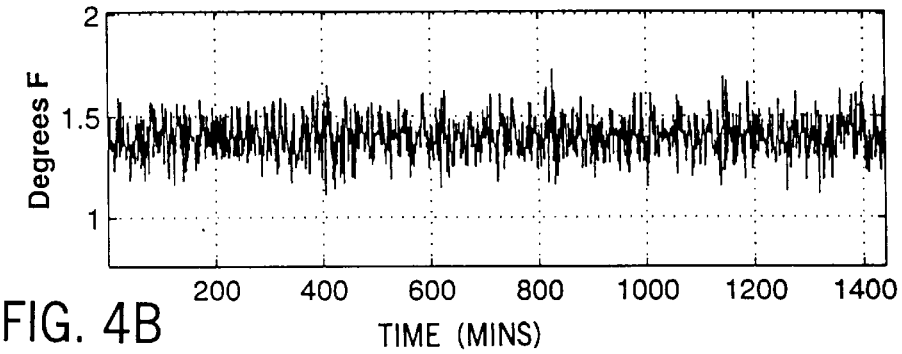
FIG. 4B illustrates the same data of FIG. 4B.
Figure 4C:
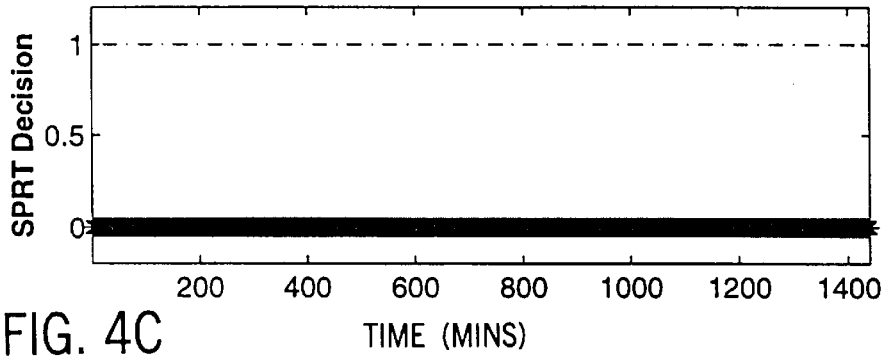
FIG. 4C illustrates the variance of the mode 1 SPRT indicators.
Figure 4D:
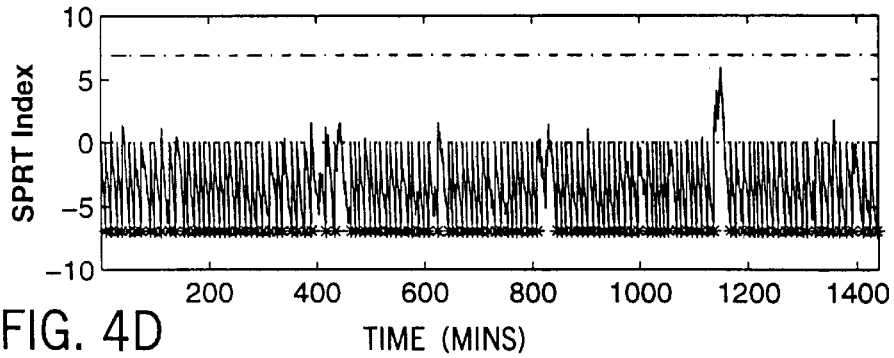
FIG. 4D shows the variance of the mode 2 SPRT indices.

In this example, temperature sensors were positioned at the outlet of the subassembly system of the EBR-II nuclear reactor at Argonne National Laboratory, Idaho. Two different locations were monitored and are denoted as 4E1 and 4F1. In FIG. 3A temperatures were sensed for a desired operating condition ("normal") over time shown in minutes. The sensed temperatures of FIG. 3A were converted to a residual function using the SPRT methodology. In FIG. 3C a set of SPRT mean value indicators (either 0 or 1 indicative of not achieving or achieving the threshold for an alarm) were determined for a mode 1 sensitivity. In FIG. 3D a set of mean value SPRT indices (actual SPRT output values) were determined for a mode 2 sensitivity which is more than mode 1. Note the lack of any noiseness of the SPRT indicators for mode 1 whereas in mode 2 the higher degree of sensitivity has lead to a noisier spectrum for the SPRT indices. FIGS. 4C and 4D show the corresponding variance for the mode 1 indicators and mode 2 indices.

EXAMPLE II

Figure 5A:
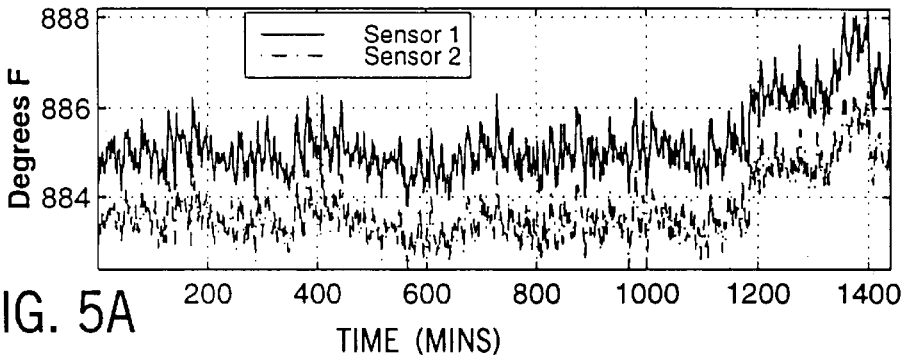
FIG. 5A illustrates subassembly outlet temperatures 4E1 and 4F1 with drift present in the data.
Figure 5B:
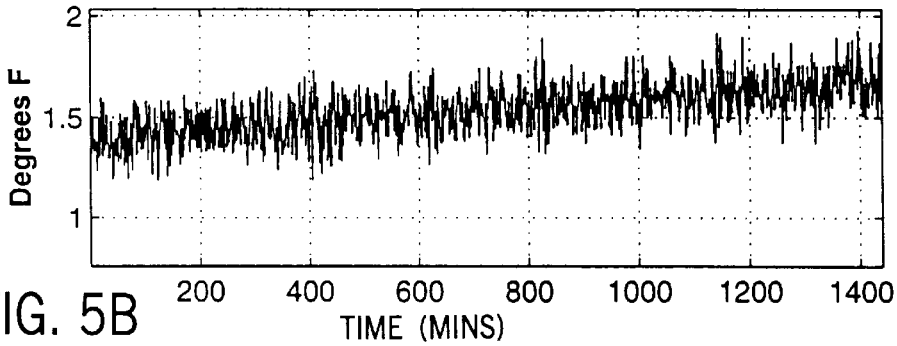
FIG. 5B illustrates a residual function for SPRT analysis of the data of FIG. 5A.
Figure 5C:
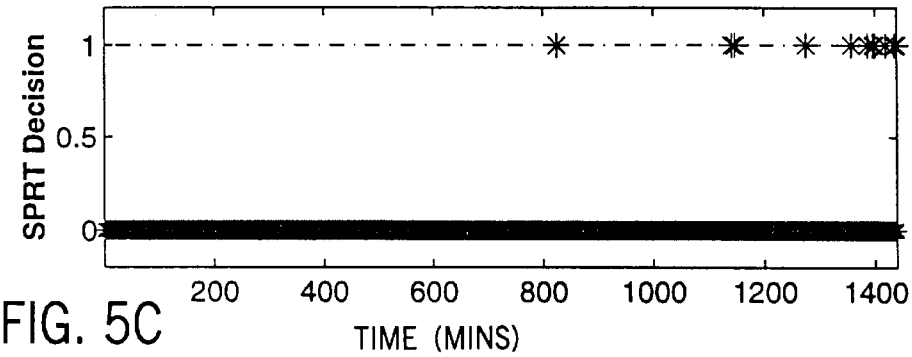
FIG. 5C illustrates mean values of mode 1 SPRT indicators for analysis of the data of FIG. 5A.
Figure 5D:
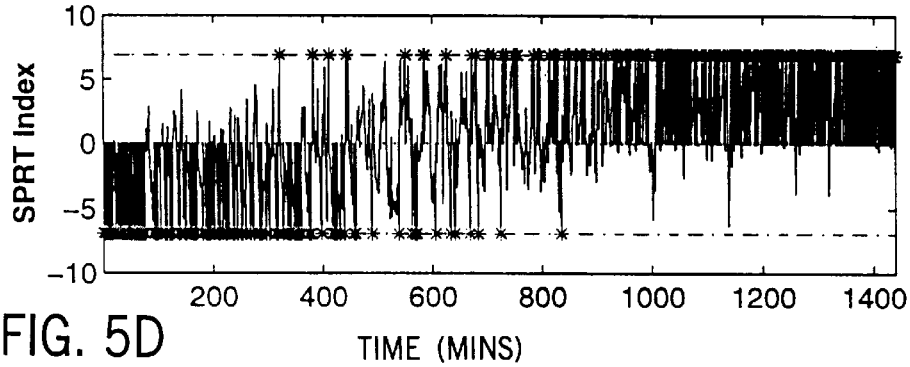
FIG. 5D shows mean values of mode 2 SPRT indices for analysis of the data of FIG. 5A.

In this example, the subassembly outlet temperatures 4E1 and 4F1 have a drift component included in FIG. 5A as compared to FIG. 3A. The residual SPRT function clearly shows the drift component in FIG. 5B. In FIG. 5C the mode 1 SPRT indicators have a number of alarms generated and the more sensitive mode 2 SPRT indices have a large number of alarms.

EXAMPLE III

Figure 6A:
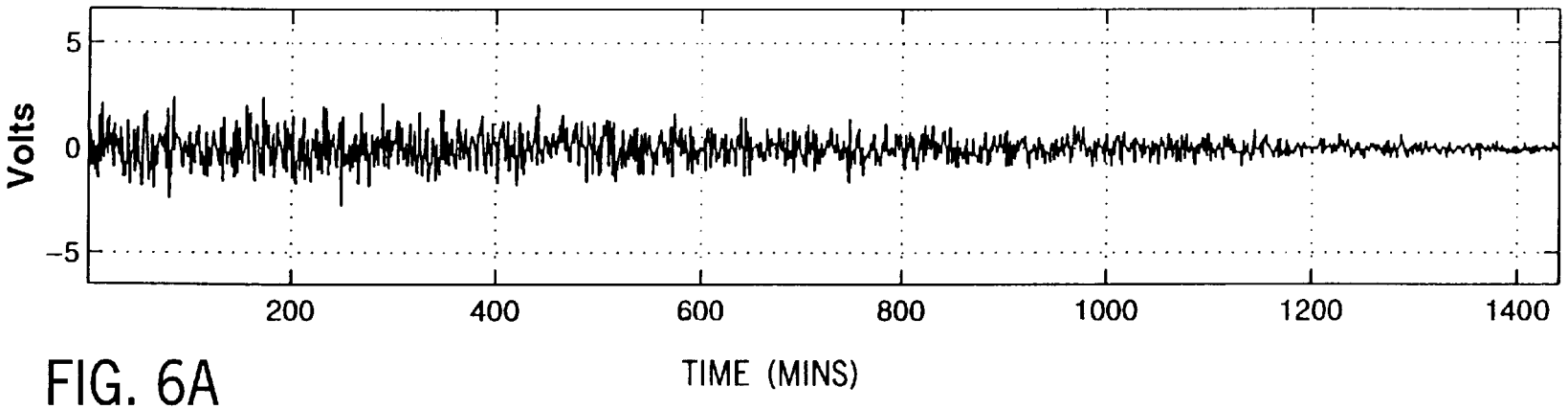
FIG. 6A illustrates an EBR-II signal with decreasing gain factor.
Figure 6B:
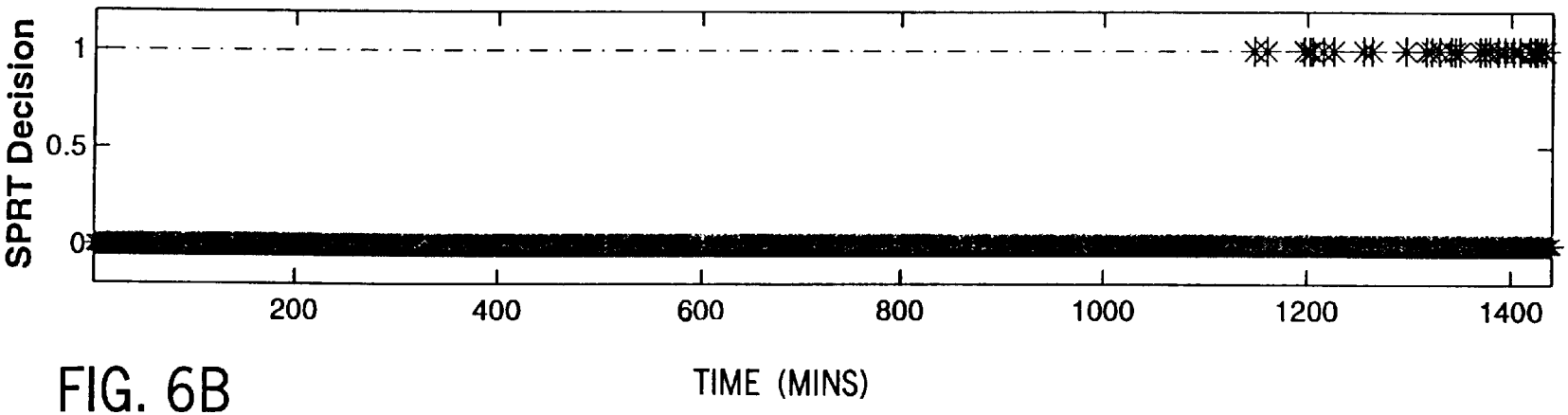
FIG. 6B illustrates variance of the mode 1 SPRT indicators for the data of FIG. 6A.
Figure 6C:
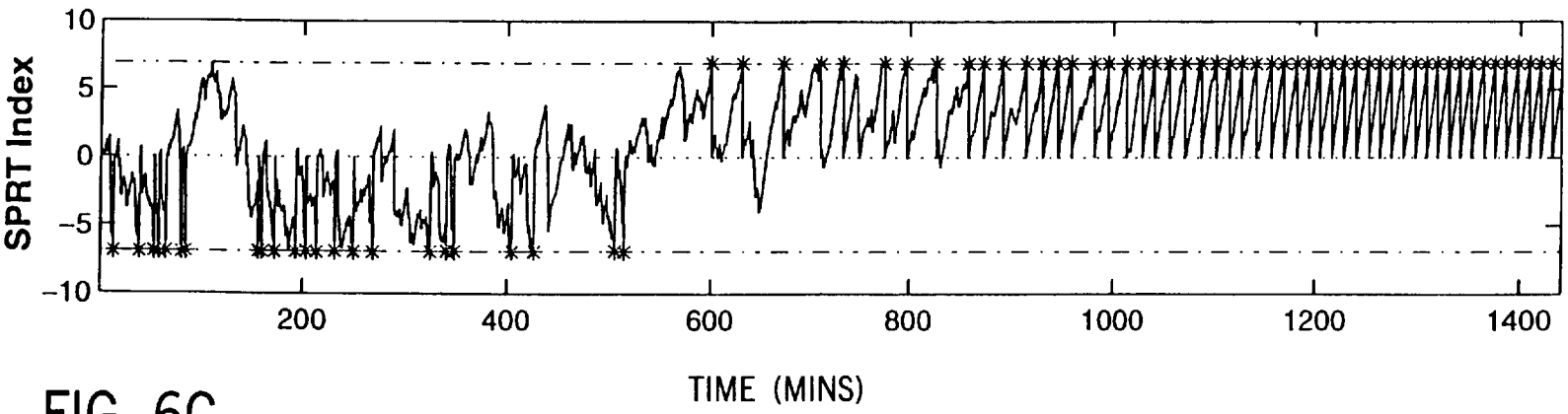
FIG. 6C illustrates variance of mode 2 SPRT indicators for the data of FIG. 6A.

This example is the same data as Example I except a decreasing gain factor is included in the data signal of FIG. 6A. In FIG. 6B the mode 1 SPRT variance indicators show alarms generated from about 1150 to 1400 minutes at testing. In FIG. 6C the mode 2 SPRT variance indices have a much earlier onset of alarms beginning at about 600 minutes testing due to the much greater sensitivity of mode 2.

EXAMPLE IV

Figure 7A:
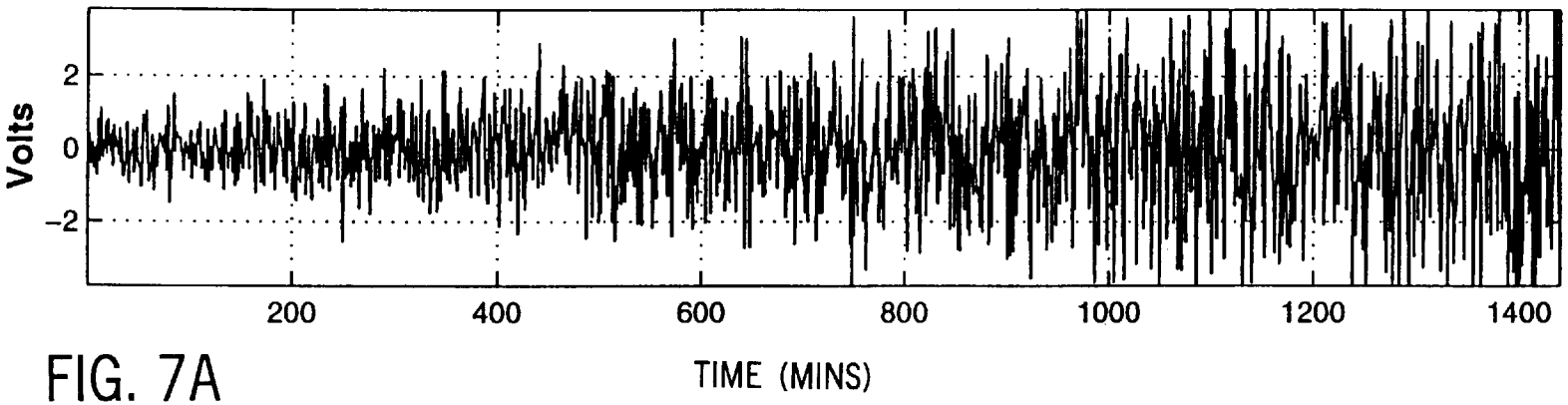
FIG. 7A illustrates an EBR-II signal with increasing gain factor.
Figure 7B:
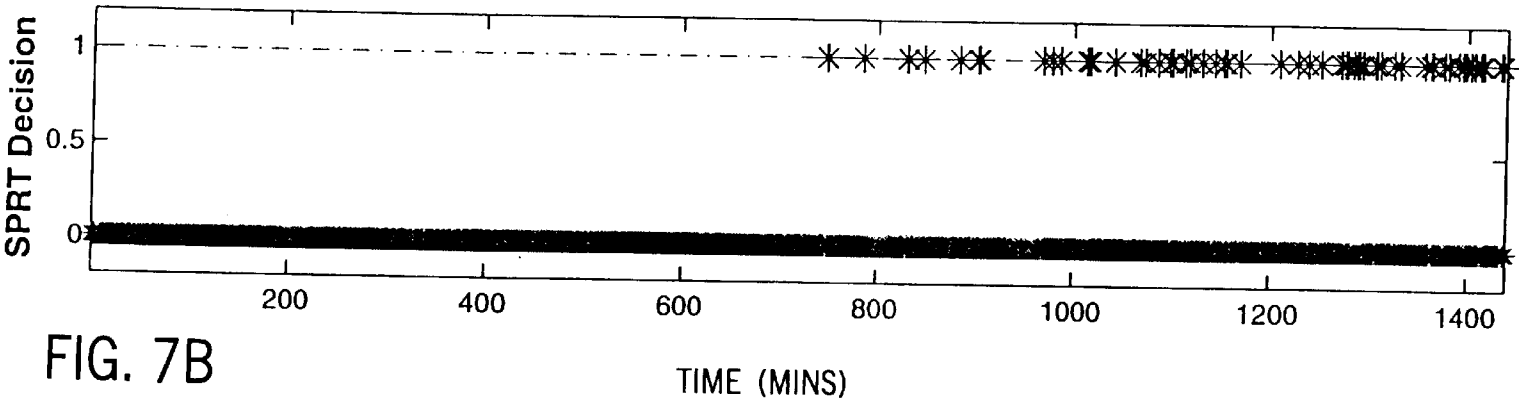
FIG. 7B illustrates variance of the mode 1 SPRT indicators for the data of FIG. 7A.
Figure 7C:
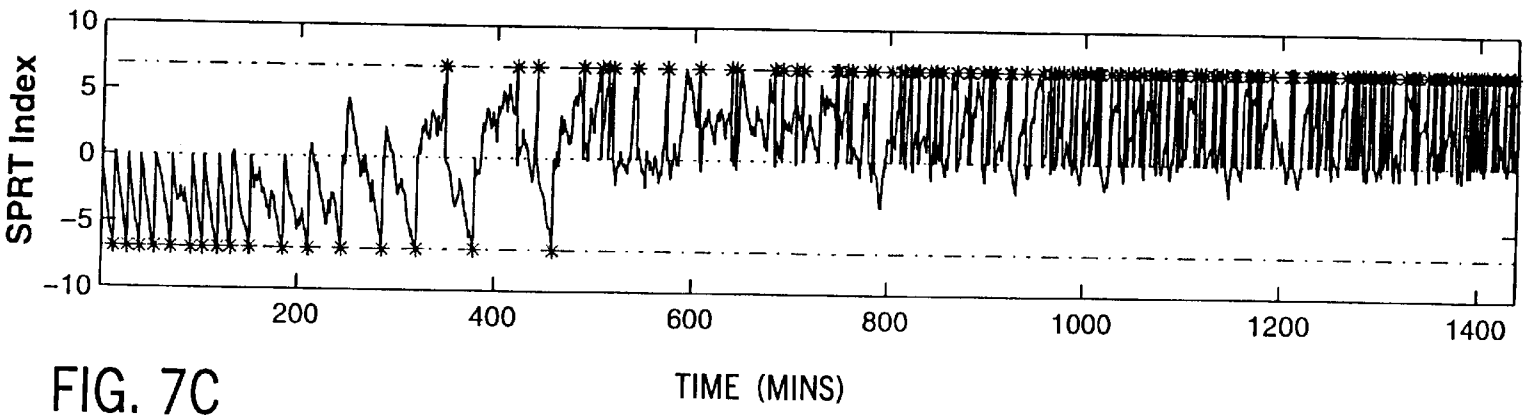
FIG. 7C illustrates variance of mode 2 SPRT indicators of the data of FIG. 7A.

This example is the same data as Example I except an increasing gain factor is included in the data signal of FIG. 7A. In FIG. 6B the mode 1 SPRT variance indicators show alarms generated from about 750–1400 minutes testing. In FIG. 7C the more sensitive mode 2 SPRT variance indices have a much earlier onset of alarms beginning about 350 minutes.

EXAMPLE V

Figure 8A:
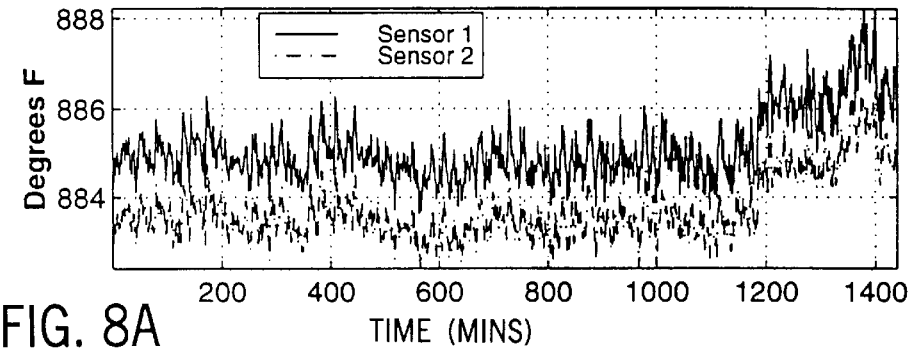
FIG. 8A illustrates subassembly outlet temperatures 4E1 and 4F1 with noise added.
Figure 8B:
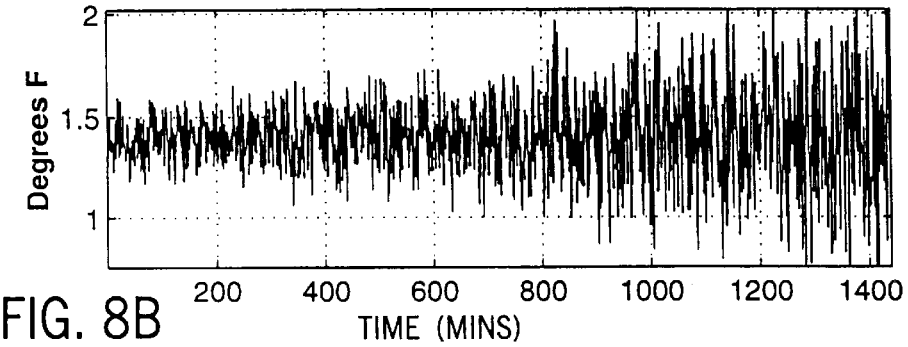
FIG. 8B shows a residual function for SPRT analysis of the data of FIG. 8A.
Figure 8C:
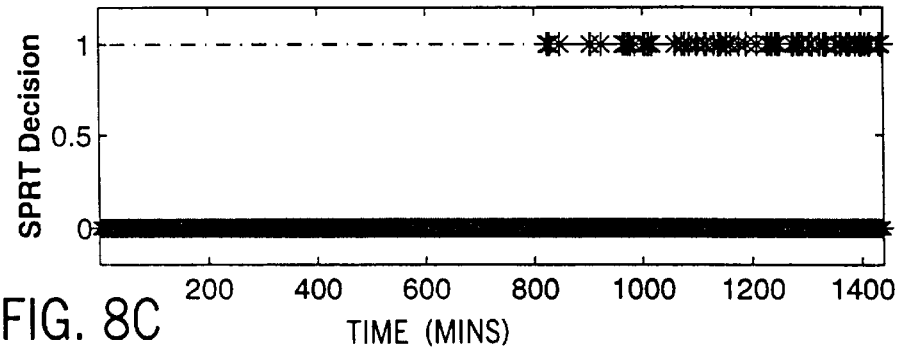
FIG. 8C illustrates variance of mode 1 SPRT indicators for analysis of the data of FIG. 8A.
Figure 8D:
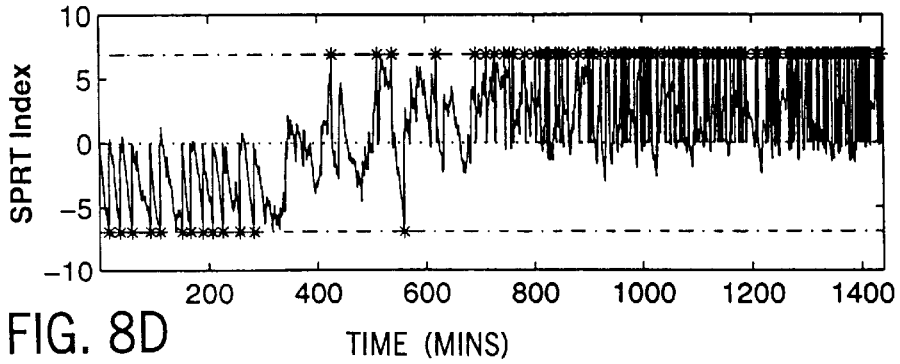
FIG. 8D illustrates variance of mode 2 SPRT indices for analysis of data of FIG. 8A.

This example is the same data as Example I except noise is included in the data of FIG. 8A. In FIG. 8B is shown the resulting residual function from the SPRT procedure. In FIG. 8C is shown the mode 1 SPRT variance indicators with alarms beginning at about 800 minutes of testing. In FIG. 8D the more sensitive mode 2 SPRT variance indices have a much earlier onset of alarms beginning about 400 minutes.

EXAMPLE VI

Figure 9A:
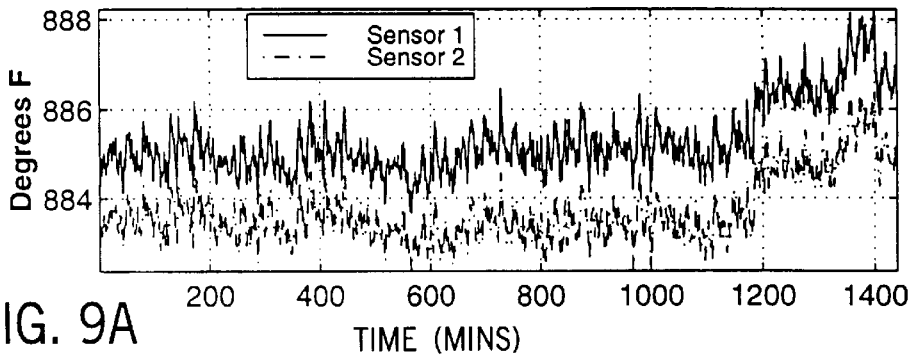
FIG. 9A illustrates subassembly outlet temperatures 4E1 and 4F1 with a step function added.
Figure 9B:
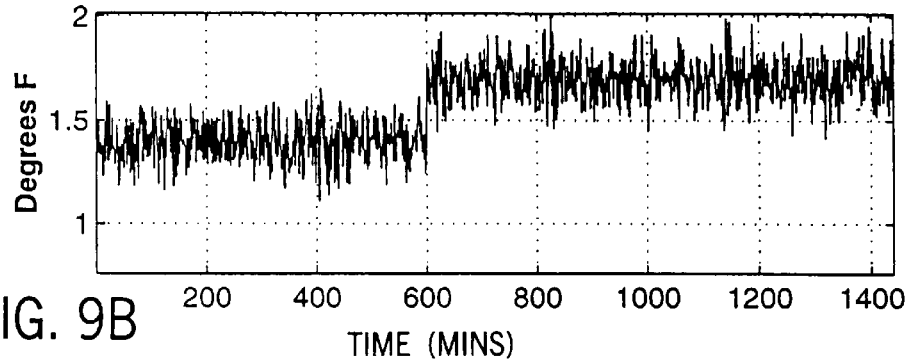
FIG. 9B shows a residual function for SPRT analysis of the data of FIG. 9A.
Figure 9C:
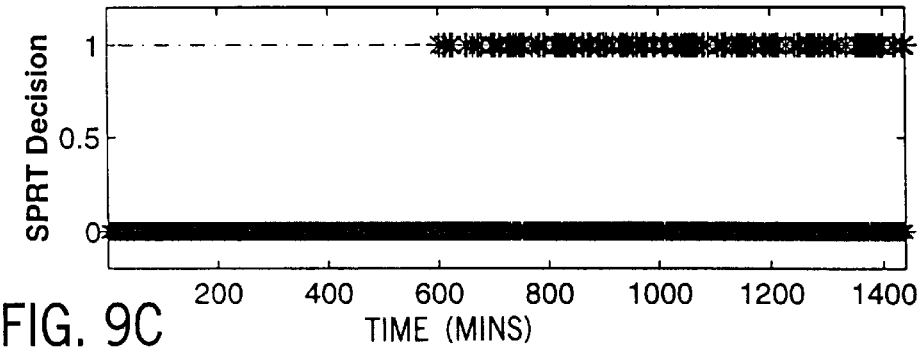
FIG. 9C illustrates mean values of the mode 1 SPRT indicators.
Figure 9D:
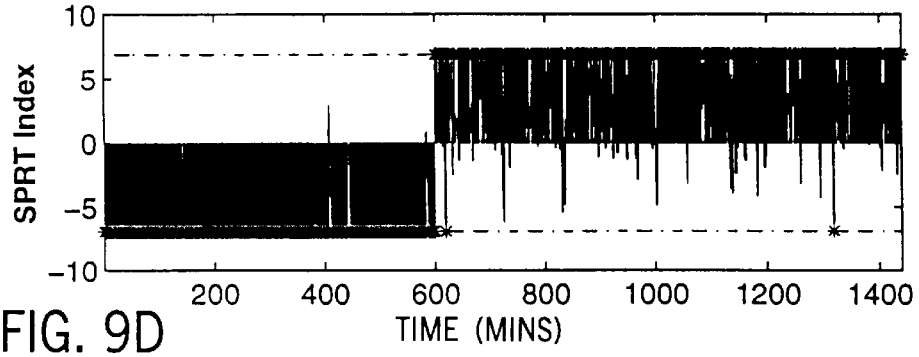
FIG. 9D illustrates mean values of the mode 2 SPRT indices.

This example is the same data as Example I except a step disturbance is included in the data of FIG. 9A. In FIG. 9B is shown the resulting residual function from the SPRT procedure. In FIG. 9C is shown the mode 1 SPRT variance indicators which alarms beginning at about 600 minutes of testing. In FIG. 9D the more sensitive mode 2 SPRT variance indices have a substantially similar onset of alarms as for mode 1 due to the substantial step function change in the data.

While preferred embodiments of the invention have been shown and described, it will be clear to those skilled in the art that various changes and modifications can be made without departing from the invention in its broader aspects as set forth in the claims provided hereinafter.

What is claimed is:

1. A method of analyzing a data source, comprising the steps of:

training a system using a desired data signal, the training including the step of calculating at least two levels of alarm sensitivity and associated pattern recognition parameters using a pattern recognition methodology;

activating a first mode of pattern recognition alarm sensitivity to monitor the data source at a first pattern recognition level of sensitivity;

upon activating the first mode of pattern recognition alarm sensitivity also activating a second mode of pattern recognition alarm sensitivity to continue to simultaneously monitor the data source at a second level of pattern recognition sensitivity;

generating a first alarm signal upon the first mode of pattern recognition sensitivity detecting an alarm condition; and generating a second alarm signal upon the second mode of pattern recognition sensitivity detecting an alarm condition.

2. The method as defined in claim 1 wherein the step of training includes selecting an incoming data signal comprising at least one of an on-line data signal and an archived data signal.

3. The method as defined in claim 2 wherein the on-line data signal and the archived data signal are used to calculate pattern recognition parameters.

4. The method as defined in claim 3 wherein the pattern recognition parameters comprise SPRT parameters.

5. The method as defined in claim 4 wherein the SPRT pattern recognition parameters comprise a separate group associated with each level of alarm sensitivity.

6. The method as defined in claim 1 further including the step of notifying an operator if the first alarm signal is generated.

7. The method as defined in claim 1 further including the step of responding to the first alarm signal by modifying a process associated with the data source.

8. The method as defined in claim 1 further including the step of responding to the first alarm signal by dumping historical alarm signal data for at least one of detailed study and action by a system specialist.

9. The method as defined in claim 8 wherein the detailed study comprises carrying out a diagnosis using an expert system.

10. A method of analyzing a data source, comprising the steps of:

training a system using a data signal from at least one of an on-line data signal and an archived data signal, the training including the step of using a SPRT pattern recognition methodology to determine at least two different levels of SPRT pattern recognition alarm sensitivity with each of the levels having an associated SPRT pattern recognition parameter;

activating a first mode and simultaneously a second mode of SPRT pattern recognition alarm sensitivity to continue to monitor simultaneously the data source using the at least two different levels of SPRT pattern recognition alarm sensitivity; and generating a first alarm if the first mode of SPRT pattern recognition alarm sensitivity detects an alarm condition and generating a second alarm if the second mode of SPRT pattern recognition alarm sensitivity detects an alarm condition.

11. The method as defined in claim 10 wherein the data source is selected from the group consisting of a business data source, a chemical process, a mechanical process, an electrical process, a medical process and a manufacturing process.

12. The method as defined in claim 10 wherein the step of activating a first mode comprises performing a set of SPRT decision tests which include (a) performing a positive mean test with a signal disturbance magnitude of $M_1^+$, (b) performing a negative mean test with a signal disturbance magnitude of $M_1^-$, (c) performing a nominal variance test with variance gain factor $V_1$ and (d) performing an inverse variance test with variance gain factor $1/V_1$.

13. The method as defined in claim 10 wherein the step of activating a second mode comprises performing a set of SPRT decision tests which include (a) performing a positive mean test with a signal disturbance magnitude of $M_2^+$, (b) performing a negative mean test with a signal disturbance magnitude of $M_2^-$, (c) performing a nominal variance test with variance gain factor $V_2$ and (d) performing an inverse variance test with variance gain factor $1/V_2$.

14. The method as defined in claim 10 further including the step of accumulating historical data characteristic of an alarm condition.

15. The method as defined in claim 14 further including a method of applying an expert system to the historical data.

16. The method as defined in claim 15 wherein the method of applying an expert system includes the steps of (a) determining type of statistical test which produced the alarm condition and (b) determining which source of data generated the alarm condition.

17. The method as defined in claim 16 wherein the step of determining which source of data generated the alarm condition includes determining which sources of data are redundant and which sources of data are monitoring a same system.

18. The method as defined in claim 16 wherein the step of determining type of statistical test is followed by establishing time of alarm and calculating alarm frequencies.

19. The method as defined in claim 16 further including the step of combining alarm information and source of data information into knowledge objects.

20. The method as defined in claim 19 further including the step of processing the knowledge objects to display a diagnosis of the source of the alarm condition.

* * * * *

UNITES STATES PATENT AND TRADEMARK OFFICE

CERTIFICATE OF CORRECTION

PATENT NO. : 6,107,919

DATED : August 22, 2000

INVENTOR: Wilks et al.

It is certified that error appears in the above-identified patent and that said patent is hereby corrected as shown below:

In Column 2, line 25, "$M_2^+$" should be changed to - - $M_2^-$ - -.

Signed and Sealed this

Eighth Day of May, 2001

*Attest:*

Nicholas P. Godici

NICHOLAS P. GODICI

*Attesting Officer*

*Acting Director of the United States Patent and Trademark Office*